United States Patent [19]

Robinson et al.

[11] 4,185,530

[45] Jan. 29, 1980

[54] AUTOMATIC GLISSANDO

[75] Inventors: John W. Robinson; Stephen L. Howell, both of Jasper, Ind.

[73] Assignee: Kimball International, Inc., Jasper, Ind.

[21] Appl. No.: 836,317

[22] Filed: Sep. 26, 1977

[51] Int. Cl.[2] ..... G10H 1/00; G10H 5/00

[52] U.S. Cl. ..... 84/1.03; 84/1.24

[58] Field of Search ..... 84/1.01, 1.03, 1.17, 84/1.24, DIG. 22

[56] References Cited

U.S. PATENT DOCUMENTS

| | | | |
|---|---|---|---|
| 3,518,352 | 6/1970 | Plunkett | 84/1.03 |
| 3,725,562 | 4/1973 | Munch, Jr. et al. | 84/1.24 |
| 3,842,184 | 10/1974 | Kniepkamp et al. | 84/1.01 |
| 3,854,366 | 12/1974 | Deutsch | 84/1.24 |
| 3,954,038 | 5/1976 | Adams | 84/1.01 |
| 4,054,078 | 10/1977 | Kondo | 84/1.24 |

*Primary Examiner*—Vit W. Miska

*Attorney, Agent, or Firm*—Albert L. Jeffers; John F. Hoffman

[57] ABSTRACT

A circuit intended for use with electronic organs and, more specifically, with those electronic organs in which the keyboard switches are multiplexed, and which circuit provides a method for automatically sounding in succession either the natural notes (white keys) or the sharped notes (black keys) to create a glissando effect, beginning at either the upper, or lower, end of the solo manual and continuing down, or up, the manual at least until the note which is depressed by the player is reached. This simulates the effect of the organist running his finger from one end of the manual partially down, or up, the manual and reaching the previously mentioned depressed key.

26 Claims, 2 Drawing Figures

AUTOMATIC GLISSANDO

BACKGROUND OF THE INVENTION

In recent years, the state of the art of electronic organs has developed to provide special effect circuits which enable a player, by the actuation of one or more special purpose switches, or keys, to simulate special musical effects, commonly performed only by experienced, expert players. Examples of this type of special effect circuit are the automatic chord circuits commonly used throughout the art, circuits for rhythmically sounding pedal keys, and circuits for playing "fill" notes in the solo manual.

The circuit of the present invention provides an additional special effect in that it allows a player to simulate a glissando effect by simply depressing a key of the solo manual while also actuating a control switch, as by the knee.

In general, the present invention discloses a method and apparatus whereby substantially random data can be inserted into a multiplexed system in proper relation to the remainder of the system.

BRIEF SUMMARY OF THE INVENTION

A special effect circuit for use with electronic organs, and especially for those organs embodying the technique of multiplexing of a least one of the manuals, for example, the solo or right hand manual. As is known, such a system involves a multiplexer which repetitively scans the solo manual keys and generates a data stream on each scan consisting of time displaced bits with key-down signals corresponding to depressed keys in respective time slots.

The data streams are supplied to a demultiplexer in which the key-down signals are employed for actuating keyers which key tones corresponding to the depressed keys. The system, known per se, and comprising the multiplexer and demultiplexer, is under the control of a master clock running at, say, 30 kilohertz.

The circuit of the present invention provides for a special effect comprising automatically sounding, in succession, each of either the natural or sharped notes from one end of the multiplexed manual to a depressed one of the keys of the manual.

The circuit of the present invention by means of which the special effect referred to is obtained enables the operator to produce a glissando effect by the depression of a single one of the keys of the multiplexed solo manual and the simultaneous depression, or operation, of a control key, such as a knee lever operated switch.

When the control switch and one of the solo manual keys are depressed, the data produced by the keyboard multiplexer circuit is interrupted, and successive single signals, corresponding to key-down signals, and generated by a low frequency clock controlled circuit, are inserted on a data stream supplied to the demultiplexer of the organ in place of the normal data stream from the solo manual multiplexer.

The substituted data stream having the low frequency clock generated key-down information will have signals corresponding to one of the natural and sharped notes between the end of the solo manual farthest from the depressed key and the depressed key, and the timing between the successive notes as determined by the frequency of the low frequency clock, say, one to ten hertz, simulates the effect of sliding the finger from the aforementioned farther end of the manual to the depressed key. When all of the notes between the end of the manual and the depressed one of the keys of the manual have been sounded, the output of the organ multiplexer circuit is reenabled to supply conventional data to the organ demultiplexing circuit.

From the foregoing it will be appreciated that the data which is inserted into the multiplexed system in the practice of the present invention is data which is not generated within the system and is, initially, not synchronized therewith, but which data, through the practice of the present invention, is inserted in the system in proper timed relation to the system.

The primary object of the present invention is to provide an electronic organ embodying a multiplexing system in which random data can be introduced into the multiplexing system.

A further object is the provision of an electronic organ and a method of operation in which glissando passages can be executed automatically at the will of the organ player.

A still further object is the provision of a system of the nature referred to in which the initiation of a glissando passage is effected by depressing a key together with the initiation of a selection command and upon which the glissando will commence at the end of the keyboard farthest from the depressed key and progress toward the depressed key and halt on the depressed key or at an earlier time if the key is released.

A still further object of the present invention is a system for an electronic organ and a method of operation in which the glissando will selectively play either the natural keys or the sharped keys depending on the keyboard which is depressed when the glissando is initiated.

The exact nature of the present invention will become more apparent upon reference to the following detailed specification taken in connection with the accompanying drawings in which.

DETAILED DESCRIPTION

Figure 1:
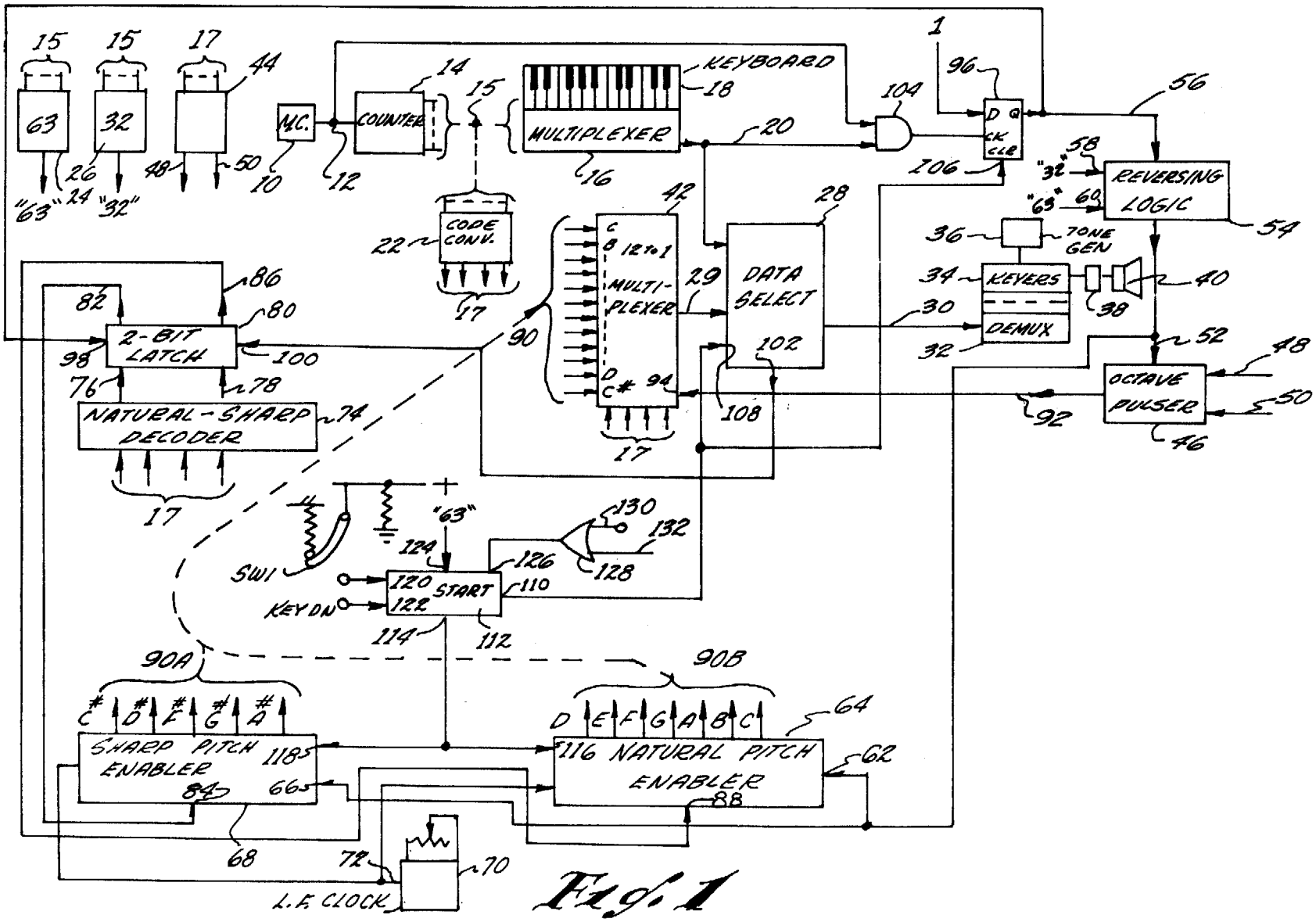
FIG. 1 is a simplified block diagram of an organic circuit embodying the circuit of the present invention.

Referring to the drawings somewhat more in detail, in FIG. 1, a master clock 10, running at a frequency of, for example, 150 kilohertz, supplies pulses to wire 12 which clocks a six bit counter 14. The outputs of counter 14 are connected to the addressing inputs of a keyboard multiplexer 16. Multiplexer 16 is connected to scan the keys of keyboard 18 and supply a serially arranged data stream to wire 20 on each keyboard scan, with the respective time slots on the data stream corresponding to respective keys of keyboard 18.

The outputs of counter 14, represented by cable 15, are also connected to the inputs of a code converter 22 and a count sixty-three decode gate or circuit 24 and a count thirty-two decode gate or circuit 26.

Wire 20 from multiplexer 16 forms a first input to a data select, or data lockout, circuit 28, which selects one of two possible inputs and connects the selected input to an output wire 30, which is connected to the input of the organ demultiplexer circuit 32.

The output of demultiplexer 32 is conventionally connected to actuate the keyers at 34, which are interposed between the tone generator 36 and the voicing and amplifier circuit 38 and speakers 40.

The second input to data select circuit 28 is connected by wire 29 to the output of a twelve to one multiplexer 42. The addressing inputs to multiplexer 42 are connected to the output terminals of code converter 22, which is in the form of a four wire cable 17, and which produces a respective four bit word at the output terminals in response to counts from counter 14.

More specifically, converter 22 supplies output words from 0 to 11 five times over, one set for each octave plus one note, and then three further words for control purposes.

As will be seen in FIG. 1, a further converter 44 is provided connected to the output cable of count decoder 22 and providing signals at the end of each octave as the keyboard 18 is scanned and which signals form one input to an octave pulser 46 which receives a second input signifying the end of a glissando sweep. The first mentioned input is indicated at 48 and the second input at 50.

The octave pulser also receives a signal via a connection 52 from a reversing logic component 54 which receives a signal via input wire 56 at the beginning of a glissando sweep and also receives a signal at terminal 58 from the count thirty-two decoder 26 and at terminal 60 from the count sixty-three decoder 24.

The output from reversing component 54 via connection 52 is also conveyed to terminal means 62 of the natural pitch enabler component 64 and terminal means 66 of a sharp pitch enabler component 68.

Each of these selectors is clocked by a low frequency clock 70 via the wire 72. Clock 70 is preferably variable in duty cycle and may also be variable in frequency and, advantageously, provides from about one to about ten hertz at the output. The frequency of clock 70, it will become apparent hereinafter, determines the speed at which notes are sounded during a glissando sweep.

By varying the duty cycle of clock 70, the duration of the tones can be changed.

A natural-sharp decoder component at 74 is supplied by the output cable 17 of code converter 22 and supplies outputs via wires 76, 78 to the input sides of a two bit latch 80 having one output 82 connected to the clear terminal 84 of the sharp pitch enabler component 68 and having a second output 86 connected to the clear terminal 88 of the natural pitch enabler component 64.

The sharp pitch enabler has five outputs corresponding to the sharped pitches in an octave and forming a cable portion 90A. The natural pitch enabler component 64, on the other hand, has seven outputs, representing the natural pitches in an octave and forming a second cable component 90B. Cable portions 90A and 90B, taken together, form the input cable 90 to multiplexer 42 previously referred to. The wires making up the cables referred to are labeled with the pitch names pertaining thereto.

The octave pulser component 46 supplies a signal via an output terminal 92 thereof to an enabling input 94 of multiplexer 42 so that the multiplexer 42 will repeat on each octave along the keyboard. As mentioned previously, the multiplexer 42 is addressed by the output cable 17 of code converter 22 and supplies its multiplexed output via wire 29 to the data selector or data lockout gating circuit at 28.

The previously referred to reversing logic component 54 receives a signal via wire 56 from latch 96 which also supplies a signal to the clocking input 98 of the two bit latch 80 previously referred to. The clear terminal of latch 80, indicated at 100, is connected to a terminal 102 of gating circuit 28.

The previously mentioned latch 96 has a potential applied to the D input thereof which is transferred to the Q output of the latch and, thus, to wire 56 when the latch is clocked. The latch is clocked by the output of an AND gate 104 which has one input connected to output wire 12 of master clock 10 and the other input connected to the output wire 20 of multiplexer 16.

The clear terminal 106 of latch 96 as well as a start terminal 108 of gating component 28 are connected to an output 110 of a start component 112 by means of which a glissando sweep is initiated. Component 112 has a further output at 114 connected to the start terminal 116 of component 64 and start terminal 118 of component 68.

The component 112 has terminals 120 and 122 for receiving start signals, the signal supplied to 122 representing the condition of a key depressed in the solo manual, while the signal supplied to terminal 120 is arrived at by the closing of a normally open switch SW1 which may, for example, be a knee switch or a special key or some other easy manual operable switch which will automatically open when released.

The component at 112 also receives a signal at a terminal 124 from the output side of the count sixty-three decoder 24.

Finally, an OR gate 128 has the output connected to an input terminal 126 of start component 112 with the two inputs of OR gate 128 being connected at 130 to a source of signals which will pulse positive when the key in the solo manual is released and, at 132, to a source of signals which will pulse positive when a key is depressed in the solo manual.

The circuitry generally described above is made up of a group of circuits which run continuously. As illustrated, these circuits are four in number and consist of the natural and sharp pitch enablers 64 and 68 together with the natural-sharp decoder 74 and two bit latch 80.

The second of the four circuits referred to can be considered to be a location detector and is under the control of the count thirty-two and count sixty-three decoders 26 and 24. The outputs of these decoders are employed, via suitable latches, to determine the location along the manual of the key which is depressed at the time a glissando sweep is initiated. The glissando sweep will then take place from the end of the solo keyboard farthest from the depressed key and will sweep toward the depressed key and will come to a halt at the key or whenever the glissando command is terminated or the depressed key is released.

The third of the circuits referred to is the arrangement for counting octaves along the keyboard so that the multiplexer 42 which supplies signals corresponding to the pitches to be played is always in step with the desired part of the data stream from the solo manual multiplexer. The octave counter has a three bit counter which is clocked by the code converter 22 and generates control signals indicative of the respective octave of the solo manual being scanned by the solo manual multiplexer.

The fourth one of the circuits referred to is the multiplexer 42 which processes the signals supplied thereto and which signals represent pitches to be played during a glissando sweep.

The signals are processed into specific time slots and form a data stream which replaces the regular data stream from the solo manual or, alternatively, may be added to the regular data stream. Multiplexer 42 is controlled by the output of code converter 22 which is, in turn, synchronized with the solo manual multiplexer so that multiplexer 42 is also synchronized with the solo manual multiplexer at all times.

Multiplexer 42 does not, however, run continuously but, rather, runs only during the period of scanning a single octave during each manual multiplexing cycle. Multiplexer 42 then runs during adjacent octave periods on successive multiplexing cycles. A simpler circuit arrangement results, and it is not necessary to update multiplexer 42 a plurality of times during a single scan of the solo manual keys by the solo manual multiplexer.

Figure 2:
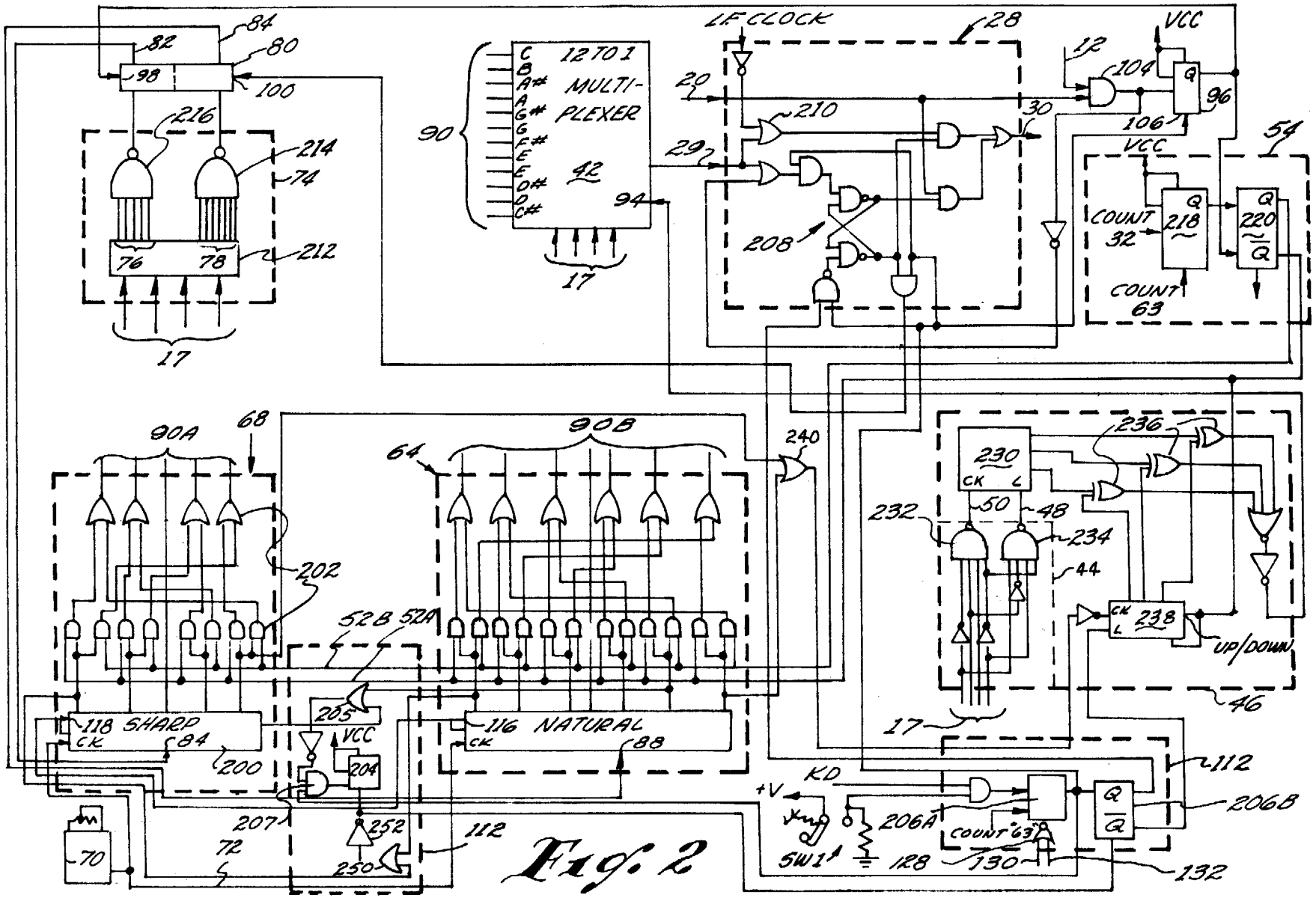
FIG. 2 is a detailed schematic of the circuit of the present invention.

FIG. 2 is a detailed showing of the principal portions of the circuitry schematically illustrated in FIG. 1. Where applicable, the portions of the circuit of FIG. 2 have been enclosed in dot-dash lines with the same reference numerals applied thereto as were employed for the respective components of FIG. 1.

In FIG. 2, components 64 and 68 will be seen to be substantially alike and only component 68 will be described in detail. In component 68, there is a shift register 200 having outputs which are supplied to gating generally indicated at 202 and forming reversing gating under the control of the output connection 52 from reversing component 54. Connection 52 will be seen in FIG. 2 to consist of two wires 52A and 52B. When wire 52A is high, the glissando will sweep upwardly from the lower end of the keyboard, and when wire 52B is high, the glissando sweep will be downwardly from the upper end of the keyboard.

The loading signal for the shift registers in the respective pitch enablers is derived from latch 204 which is part of the start component 112 and which is clocked from the output from latch 206A that receives a start command jointly from the keydown detector and switch SW1. It will be noted that latch 204 is cleared by the first output from either one of the shift registers and a further latch 206B forming a part of the start component is also cleared at this time. The purpose of the clearing operation is to provide for a single high bit only to advance along the respective shift register as it is clocked by low frequency clock 70.

The outputs of the enabled one of the pitch enablers is supplied to multiplexer 42 and appears on output line 29 in the form of signals corresponding to key-down signals and in respective time slots. The data selector block 28 has been triggered to pass glissando data by an output signal in the aforementioned latch 206B of the start block and which signal has set a memory unit, at R-S flip flop 208, into condition to pass data from multiplexer 42 while cutting off the data flow on wire 20.

It will be noted that the gating component 28 may include an inverted input from clock 70 to one input of an OR gate 210, the other input of which receives the data stream from wire 29. This circuitry chops the signals supplied to wire 30 to vary the duration and spacing thereof during a glissando sweep to obtain a percussive effect. The degree of percussive effect obtained depends on the duty cycle of clock 70 and which can be varied.

The natural-sharp decoder at 74 will be seen to comprise a decoder 212 having a group of outputs supplying the NAND gate 214 and a further group of outputs supplying a NAND gate 216. Gate 214 has an output which goes low on each time slot corresponding to a natural note while gate 216 has an output which goes low on each count corresponding to a sharped note. The state of the outputs of gates 214 and 216 is clocked into latch 80 when the multiplexer detects a key depressed so the state of the outputs of latch 80 indicates whether the depressed key was a natural key (white) or a sharped key (black). The aforementioned latch 80 has two outputs, each of which will clear the shift register of a respective one of the components 64 and 68.

Referring to the reversing logic at 54, this will be seen to comprise two D-type flip flops, or latches, 218 and 220 in serial arrangement with the first receiving a clock signal from the thirty-two count decoder 26 and a clear signal from the sixty-three count decoder 24. Latch 220 provides the outputs to wires 52A and 52B. Latch 220 is clocked by latch 96 which, in turn, is clocked by gate 104 and is cleared by a start signal from latch 206A.

It will be seen that the output of latch 218 will change at count thirty-two while latch 96 pulses upon the occurrence of a depressed key. The component 54 thus provides an indication of the region along the keyboard of the depressed key and determines the direction of the glissando sweep.

The octave pulser 46 will be seen to comprise a counter 230 having a clock terminal connected to a decoder 232 and a load terminal connected to a decoder 234. Counter 230 has three outputs, each of which is connected to one input of a respective one of three exclusive OR gates 236. The other inputs of the respective gates are connected to outputs of a counter 238 having an up-down terminal connected to line 52A and having a load terminal connected to the $\overline{Q}$ output of flip flop 206B.

The counter 238 is adapted for being clocked by the last output of the enabled one of the shift registers of the respective pitch enablers 64 or 68 via an OR gate 240.

When the signal in the enabled shift register leaves the next to the last station of the respective register, latch 204 is again reset, via OR gate 205 and AND gate 207 to provide for a further input to the front end of the enabled shift register for the next octave.

Operation

In operation, assuming switch SW1 to be closed to make the glissando circuitry of the present invention effective, and assuming, further, that D sharp above low C of the keyboard is depressed, the following cycle of operation will take place:

The signals from the key-down detector and switch SW1 will be supplied through AND gate 240 to the D input of latch 206A which will be clocked on count sixty-three to cause the Q output of the latch to go high. A high on the Q output of latch 206A will clock latch 206B which, in turn, will clock the load terminal of counter 238. The note depressed is in the lower half of the manual so that the Q output of latch 220 will be high and the $\overline{Q}$ output will be low thus loading a zero in counter 238.

Furthermore, since the key is a sharped key, the sharp output of latch 80 will go high and enable component 68.

The Q output of latch 206A will also clock latch 204 and provide the logic 1 signal at the Q output thereof which will be supplied to load terminal 118 of shift register 200 of sharp component 68. As soon as the bit loaded into shift register 200 appears at the first output thereof, latch 204 will be cleared via OR gate 250 and inverter 252 so that only a single high bit passes along shift register 200 as it is clocked by clock 70.

The gating at 202 determines the direction of the glissando sweep which, in this case, is downward so that the output wires representing the wire bundle 90A will be pulsed commencing with the one at the right marked A#, terminating with the one at the left marked C#.

The outputs of counter 238, compared with the outputs of counter 230 via exclusive OR gates 236 determine the respective octave during a scan by multiplexer 16 that the multiplexer 42 runs, or is effective. The respective octave will, of course, shift in a respective direction along the keyboard for each complete cycle of the enabled one of the shift registers of the pitch enabler components 64, 68.

Furthermore, when the signal in the shift register leaves the next to the last station thereof, latch 204 is again enabled to supply a signal back to the input end of the shift register so that the cycle of shifting a high bit along the respective shift register is repeated.

The foregoing cycle continues until the signal from multiplexer 42 occurs in the same time slot as that corresponding to the depressed key, in this case, D# above low C. At that time, the glissando sweep is completed and the glissando system shuts down by resetting memory, or flip flop, 208. The conventional data stream on wire 20 now passes to the demultiplexer in a conventional manner, also, latch 80 is cleared and both of components 64, 68 become idle.

The glissando can be restarted if the depressed key is released and another is depressed while still holding switch SW1 in closed position.

If, during a glissando sweep, either the depressed key or the switch SW1 is released, latch 206A will clear at the next count sixty-three and the glissando sweep will be interrupted while the normal flow of data from the solo keyboard multiplexer will be resumed.

Assuming the D# key below high C is depressed, the same cycle of operations will take place, except the glissando will sweep upwardly from the lower end of the keyboard with the octaves during which multiplexer 42 runs being successively depressed upwardly from the left hand end of the keyboard.

The operation of the system when a natural note is depressed is exactly the same except that the two bit latch 80 will select the natural pitch enabler 64 while the sharp pitch enabler 68 will remain idle.

What is claimed is:

1. An electronic organ comprising:

a keyboard comprising a set of natural keys and a set of sharp keys, multiplexer means for scanning said keys and producing a serial data stream having a plurality of time slots corresponding respectively to said keys wherein keydown signals are present in time slots corresponding to depressed ones of said keys, a plurality of keyers, demultiplexer means synchronized with said multiplexer means and having an input connectable to receive said serial data stream, said demultiplexer means demultiplexing the serial data received at its input and activating keyers corresponding to time slots in the serial data at its input in which a keydown signal is present, signal generating means responsive to the depression of a key of one of said sets for automatically generating a second time division multiplexed serial data stream synchronized with said first mentioned serial data stream comprising keydown signals in time slots corresponding to keys of said one set wherein the respective keydown signals in said time slots corresponding to said one set of keys appear in ascending or descending succession at a glissando rate much slower than the rate at which said keyboard is scanned, and means for selectively connecting said second data stream to said demultiplexer means input.

2. Apparatus according to claim 1 in which said keyboard comprises a plurality of octaves and said signal generating means includes a first and second shift register each having the same number of stations as there are keys of a respective one of said sets in an octave.

3. Apparatus according to claim 2 in which said signal generating means includes first detector means operable to detect the set of the depressed key and means actuated by said first detector means for making the pertaining shift register effective for supplying said second serial data stream.

4. Apparatus according to claim 2 which includes a low frequency clock connected to clock said shift registers at glissando rate, each shift register having no more than a single signal only therein at any time.

5. Apparatus according to claim 1 which includes means for chopping said second serial data stream to make the sound produced during a glissando passage discontinuous.

6. Apparatus according to claim 1 in which said signal generating means includes a low frequency clock running at said glissando rate, and including means operated by said clock for chopping said second serial data stream to provide for a staccato effect during a glissando passage.

7. The apparatus of claim 1 including first detector means operable to detect the set of the depressed key, and signal control means actuated by said first detector means for causing said signal generating means to generate only keydown signals corresponding to said one set of keys.

8. The apparatus of claim 1 including: first detector means operable to detect the set of the depressed key, signal control means actuated by said first detector means for causing said signal generating means to detect only keydown signals corresponding to said one set, and second detector means operable to detect the location of the depressed key between the ends of the keyboard and to cause said signal generating means to initiate the succession of keydown signals at or near the end of the keyboard spaced the greatest number of keys from the depressed key.

9. The apparatus of claim 1 wherein said keyboard comprises a plurality of octaves and said signal generating means repetitively generates a set of keydown signals corresponding to the keys of a single octave in said one set of keys, said sets of keydown signals being presented to said demultiplexer means in succession.

10. The apparatus of claim 1 including means for making said signal generating means ineffective to generate said second serial data stream when said key of one of said sets is released.

11. A method for automatically playing glissando passages on an electronic organ having a multiple octave keyboard comprising a set of natural keys and a set of sharp keys with each key developing a keyer actuating first signal when depressed and signal actuated keyers controlling respective pitches and connected to receive signals from said keys, said method comprising: developing a glissando command, depressing a key, automatically detecting the set pertaining to the depressed key and determining the end of the keyboard farthest from the depressed key, automatically generating keyer actuating second signals at glissando rate, and supplying said second signals in succession to the keyers of the detected set commencing with the end of the keyboard farthest from the depressed key and terminating the glissando passage at the depressed key.

12. The method according to claim 11 which includes terminating the glissando passage upon the occurrence of any one of the termination of the glissando command and the releasing of the depressed key and the glissando passage reaching the depressed key.

13. The method according to claim 11 which includes chopping said second signals.

14. The method of claim 11 and including controlling the duration of said second signals so as to control tone duration.

15. An electronic organ having apparatus for automatically playing glissando passages comprising: a keyboard comprising a set of natural keys and a set of sharp keys each operable to develop a keyer actuating first signal when depressed, keyers for respective pitches adapted to receive the actuating signals from respective keys, signal generating means for generating keyer actuating second signals independently of said keys, control means responsive when effective to the depression of a key for supplying said second signals in succession and at a glissando rate to keyers pertaining to a set of said keys, said keyboard comprising a plurality of octaves, said signal generating means including first and second shift registers each having the same number of stations as there are keys of a respective one of said sets in an octave, and variable duty cycle low frequency clock means for clocking said shift registers at glissando rate and for controlling the duration and spacing of said second signals in response to the duty cycle of said low frequency clock, each said shift register having no more than a single signal therein at any time.

16. Apparatus according to claim 15 which includes direction means connected between output terminals and the stages of each shift register, and means controlling said direction means for determining the direction of progression of a signal along the output terminals for one and the same direction of a signal along the respective shift register.

17. An electronic organ having apparatus for automatically playing glissando passages comprising: a keyboard comprising a set of natural keys and a set of sharp keys, the keys of said keyboard being arranged in octaves, a multiplexing system having a first multiplexer means for scanning said keys and a demultiplexer synchronized with said first multiplexer means, said multiplexing system including a high frequency clock controlling the rate of scanning of the keyboard by said first multiplexer means, enabler means for sequentially producing a plurality of outputs corresponding to the keys of at least one of said sets at a glissando rate substantially slower than the rate at which said keyboard is scanned by said first multiplexer means, second multiplexer means driven by said high frequency clock for time division multiplexing the outputs of said enabler means to produce a serial data stream of octave length comprising keydown signals corresponding to the keys of one octave of at least one of said sets, means for connecting said serial data stream to said demultiplexer, and control means responsive to the depression of a key of the keyboard for enabling said second multiplexer means at the beginning of the scanning of each octave of the keyboard by said first multiplexer means.

18. The electronic organ of claim 17 wherein said enabler means comprises first and second enablers for said natural and sharp sets, respectively, and including means responsive to the depressed key for activating only the enabler corresponding to the set of said depressed key.

19. A method for automatically playing glissando passages on an organ having a multiple octave keyboard comprising a set of natural keys and a set of sharp keys and a multiplexer which scans the keyboard and produces a serial data stream having a plurality of time slots corresponding respectively to the keys with keydown signals present in time slots corresponding to depressed ones of the keys, and a demultiplexer which receives said data stream, said method comprising:

depressing a key of one of said sets, automatically generating a second time division multiplexed serial data stream synchronized with the first serial data stream comprising keydown signals in time slots corresponding to keys of at least one of the sets, wherein the successive keydown signals in the second serial data stream appear sequentially in ascending or descending order at a glissando rate much slower than the rate at which the keyboard is scanned by the multiplexer, and supplying the second serial data stream to the demultiplexer.

20. The method of claim 19 wherein the second serial data stream contains only keydown signals pertaining to the set of the depressed key.

21. The method of claim 19 including selectively interrupting the supply of the first serial data stream to the multiplexer when the second serial data stream is supplied thereto.

22. The method of claim 19 wherein the successive keydown signals appear sequentially in the second serial data stream commencing with a keydown signal at or near the end of the keyboard spaced the greatest number of keys from the depressed key.

23. The method of claim 19 which includes interrupting the supply of the second serial data stream to the demultiplexer when the keydown signal pertaining to the depressed key appears in the second serial data stream and resuming the supply of the first serial data stream to the demultiplexer.

24. The method of claim 23 wherein the successive keydown signals appear sequentially in the second serial data stream commencing with a keydown signal at or near the end of the keyboard spaced the greatest number of keys from the depressed key.

25. An electronic organ having apparatus for automatically playing glissando passages comprising: a keyboard comprising a set of natural keys and a set of sharp keys each operable to develop a keyer actuating first signal when depressed, keyers for respective pitches adapted to receive the actuating signals from respective keys, signal generating means for generating keyer actuating second signals independently of said keys, control means responsive when effective to the depression of a key for supplying said second signals in succession and at glissando rate to keyers pertaining to a set of said keys, said keyboard comprising a plurality of octaves, said keys being connected to said keyers by a multiplexing system having a first multiplexer means for scanning the keyboard and a demultiplexer, said system including a high frequency clock controlling the rate of scanning of the keyboard by said first multiplexer means, a second multiplexer means operated by said high frequency clock and operable to produce a serial data stream of octave length, said control means including means for enabling said second multiplexer means at the beginning of the scanning of each octave of the keyboard by said first multiplexer means.

26. Apparatus according to claim 25 which includes means operable when said control means is effective for interrupting the connection of said first multiplexer to said demultiplexer and for, instead, connecting said second multiplexer to said demultiplexer.

* * * * *